United States Patent [19]

Black

[11] 4,392,478

[45] Jul. 12, 1983

[54] PORTABLE HEAT CIRCULATION MEANS

[76] Inventor: Hugh J. Black, 39 Iowana Ave., Trenton, N.J. 08638

[21] Appl. No.: 282,692

[22] Filed: Jul. 13, 1981

[51] Int. Cl.[3] ..... F24C 15/20; F24H 3/02

[52] U.S. Cl. ..... 126/84; 126/110 AA; 126/110 D; 165/121

[58] Field of Search ..... 126/116 R, 110 R, 110 A, 126/110 AA, 110 B, 110 C, 110 D, 110 E, 135, 136, 84; 165/120, 121

[56] References Cited

U.S. PATENT DOCUMENTS

| | | | |
|---|---|---|---|
| 283,149 | 8/1883 | Rowan | 126/84 |
| 495,528 | 4/1893 | Stuyvesant | 126/84 |
| 960,400 | 6/1910 | Rector | 126/84 |
| 1,380,135 | 5/1921 | Corbin | 126/110 |
| 2,069,190 | 1/1937 | Woolley | 165/121 |
| 2,262,898 | 11/1941 | MacGregor | 165/121 |
| 2,453,913 | 11/1948 | Higley | 126/110 |
| 2,619,953 | 12/1952 | Cunningham | 126/84 |
| 2,647,506 | 8/1953 | Heiman | 126/110 |
| 2,734,500 | 2/1956 | Myers | 126/110 |
| 2,942,600 | 6/1960 | Heiman | 126/110 |
| 3,010,449 | 11/1961 | Owen | 126/110 |
| 3,324,938 | 6/1967 | Berkoff | 165/121 |
| 3,880,140 | 4/1975 | Scogin | 126/110 |
| 4,184,473 | 1/1980 | McIntire et al. | 126/136 |

*Primary Examiner*—Daniel J. O'Connor

*Attorney, Agent, or Firm*—Frederick A. Zoda; John J. Kane; Albert Sperry

[57] ABSTRACT

A heat circulation device is provided which is portable to be usable placed upon conventional space heaters and particularly upon kerosene fueled heaters which includes a plenum housing adapted to be placed upon the heater which defines a plenum chamber therein for gathering heated air. The upper surface of the plenum chamber defines a generally convex heated surface and the sidewalls of the plenum chamber include apertures therein. A main housing is located immediately above the plenum housing which is adapted to provide a flow of cool air via a blower assembly wherein this cool air is guided to travel across the convection surface to be warmed thereby and then to travel past the hot air apertures to create a suction thereagainst similar to the Venturi principle and hence draw warm air outward therefrom. In this manner the heated air being supplied into the plenum chamber from the kerosene or other heater will be re-circulated in an outwardly directed manner 360° with respect to the heat circulation device itself. The convection surface is convexed and inclined slightly downwardly in all directions to thereby urge this warm air into the lower areas of the surrounding room to facilitate circulation thereof.

12 Claims, 2 Drawing Figures

PORTABLE HEAT CIRCULATION MEANS

BACKGROUND OF THE INVENTION

1. Field of the Invention

Due to the severe energy shortage, many devices are currently being marketed which are useful for heating specific small areas within a given building and thereby obviate heating of non-occupied areas thereof. The most common type of such heater is the kerosene heater since it has shown to be more reliable and less costly and specifically less dangerous than electrical space heaters. The main disadvantage of such kerosene heaters is that the heat is supplied in a very narrow area which is normally a cylindrical column extending upwardly from the heater to the ceiling of the room. Since hot air normally rises, this column tends to stay confined within itself which results in a limited heating of the lower areas of the room which are actually the areas which need heating for comfort. For this reason the present invention provides a portable design which is usable for basically any type of heater and specifically for kerosene heaters and can be used on more than one kerosene heater within a given house since it is portable which is simple in design and limited in energy consumption.

2. Description of the Prior Art

There are many prior art designs for blower configurations such as U.S. Pat. Nos. 2,453,913; 2,647,506; 2,734,500; 2,942,600; 1,380,135; 3,010,449 and 3,880,140. However, none of these designs is adapted to be portable such that it is movable from one type of heater to another type of heater or portable between a plurality of similarly configured heaters. The present design is portable due to its lightweight nature which is achieved due to the particular structure of the plenum housing and main housing thereof.

SUMMARY OF THE INVENTION

The present invention provides a portable heat circulation device which is particularly adapted to be usable when placed upon the top of a heater such as a kerosene heater or the like to gather and distribute the air therefrom in a more even manner throughout the room to be warmed.

The circulation means includes a plenum housing which is adapted to be directly placed on top of the kerosene heater. This plenum housing defines a plenum chamber therein which is adapted to gather the heated air provided from the heater. This heated air is introduced into the plenum chamber through a plenum intake means which is an open area in the bottom surface of the plenum housing. A plenum wall extends around the plenum chamber and defines therein a number of hot air apertures which allow the flow of heated air from the plenum chamber into the surrounding environment.

The upper boundary of the plenum chamber is defined by a plenum top means which extends over the plenum wall means. This plenum top means is generally of the convex configuration facing in an upward direction. In this manner an arcuate surface is provided as the top wall of the plenum chamber. In this manner this surface is heated and when cool air is caused to pass thereover, a means of circulation of warm air is provided.

A main housing means is fixedly secured to the plenum housing means preferably by way of a plurality of legs extending therebetween. The bottom surface of the main housing means includes a main outlet means such that cool air can be expelled outwardly therethrough. This main outlet means is positioned adjacent to the convection surface such that it can travel along the convection surface and pick up the heat therefrom for dissemination into the surrounding environment. The lower end of the main housing means and the upper portion of the plenum housing means defines a main outlet means therebetween such that air after it has traveled through the cool air outlet and been warmed by passing adjacent to the convection surface can pass outwardly into the surrounding environment for heating thereof.

The main housing means defines a cool air chamber therein which is adapted to admit cool or room temperature air thereinto through cool air inlets defined in the plenum housing means. A blower means is located within the main housing means and is operative to draw cool air inwardly through the cool air inlet means into the cool air chamber. This air can then travel outwardly through the cool air outlet along the convection surface for heating thereof and outwardly through the main outlet into the room area.

This blower means preferably includes a fan means which itself is mounted within the main housing means as well as a drive means which is operatively secured with respect to the fan means for powering thereof. A control means may be included in the plenum housing for varying the speed of rotation of the fan means and an indicator means may be defined in the plenum housing to show the on condition of a switch means within the housing.

The main housing may also define a drive compartment within which the drive means is located. This drive compartment may be formed by the placement of firewall means within the plenum housing to define the separate drive compartment. This firewall means is adapted to minimize the dangers of excessive heat on the drive means. In order to facilitate the flow of cool air into the cool air chamber and in order to disseminate excessive heat built therein, the firewall means may include a plurality of apertures in areas not adjacent to the drive means. In this manner some heat protection of the drive means is achieved. To maximize heat protection of the drive means a heat shield may be fixedly secured with respect to the drive wall between the drive means and firewall and specifically may be fixedly secured in spaced relation with respect to the firewall to maintain a further level of protection.

It is preferable that the main outlet means of this heat circulation device is located adjacent to the hot air apertures of the plenum housing such that as the air is traveling past the apertures a suction is created similar to the Venturi principle with warm air being drawn outwardly through the hot air apertures from the plenum therein. To facilitate this interaction, a lip means may be included as an extension of the upper convex surface of the plenum housing to extend downwardly over the plenum wall means. In this manner the suction and speed of air travel adjacent to the hot air apertures can be increased or controlled.

It is an object of the present invention to provide a heat circulation means which is portable in nature and as such is usable with a plurality of different heaters.

It is an object of the present invention to provide a portable heat circulation means which is simple in design in order to be relatively inexpensive in construction.

It is an object of the present invention to provide a portable heat circulation means which is most easily maintained.

It is an object of the present invention to provide a portable heat circulation device which is light in weight to facilitate operation thereof.

It is an object of the present invention to provide a portable heat circulation means which includes a variable control to vary the speed of operation thereof.

It is an object of the present invention to provide a portable heat circulation means which includes heat protection means for the drive means thereof.

It is an object of the present invention to provide a portable heat circulation means to insure an efficient method of heating areas in which kerosene and other heaters are used.

It is an object of the present invention to provide a portable heat circulation means which circulates air from a kerosene heater throughout 360° all around the heater.

It is an object of the present invention to provide a portable heat circulation means which urges warm air toward the areas in a room where heating is normally required rather than letting it rise to the ceiling.

It is an object of the present invention to provide a portable heat circulation means which minimizes energy usage of the heat circulation means as well as of the heating means to which it is attached.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 2:
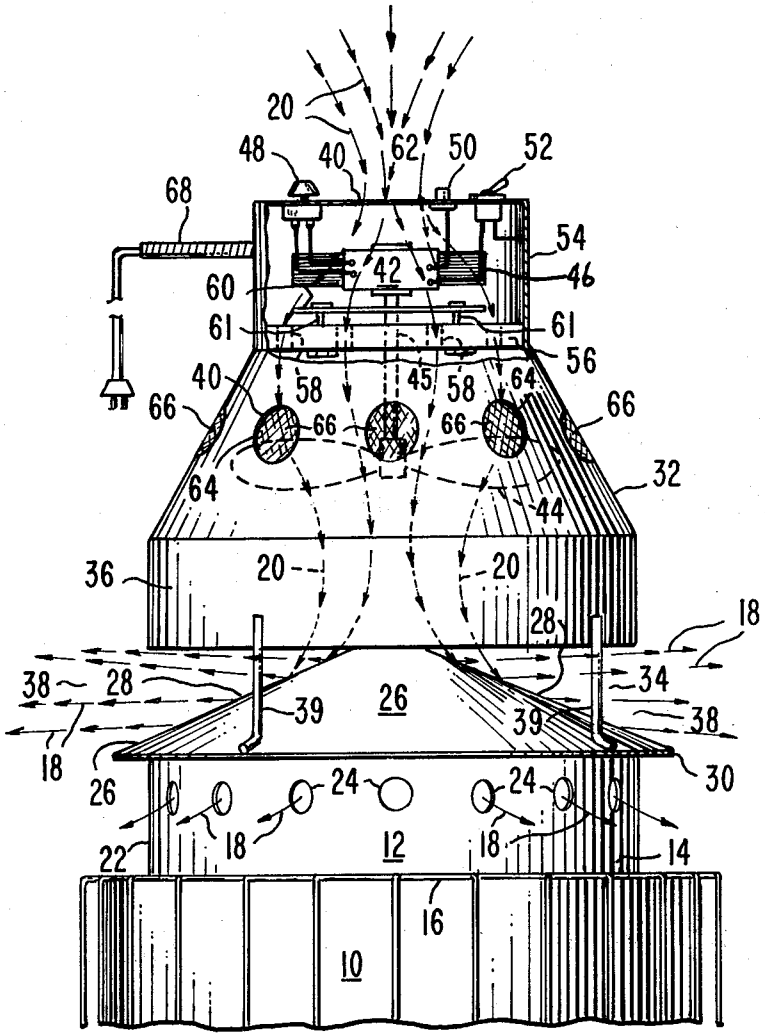
FIG. 2 is a front plan view being partially in cross-section of an embodiment of the portable heat circulation means of the present invention.
Figure 1:
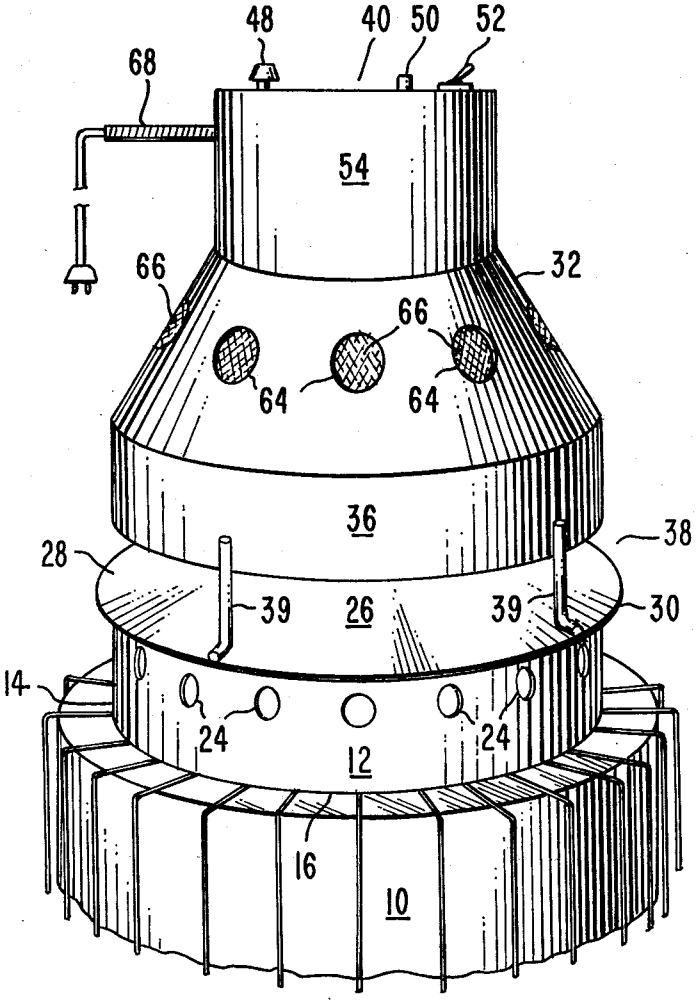
FIG. 1 is a perspective illustration of an embodiment of the portable heat circulation means of the present invention.

The portable heat circulation means of the present invention includes a plenum housing 12 which is adapted to be placed upon a conventional heater such as a kerosene heater 10 as shown in FIGS. 1 and 2. This plenum housing is adapted to gather the heat normally traveling directly upward from such a heater 10. This heat is gathered within the plenum chamber 14 of the plenum housing 12 and enters chamber 14 through a plenum intake means 16 which is normally an open bottom area thereof.

The plenum housing includes a laterally extending plenum wall 22 which may be cylindrical in cross-section and which provides the sidewall areas bounding the plenum chamber 14. Plenum wall 22 preferably includes a plurality of hot air apertures 24 therein to facilitate the movement of warmed air laterally outward from the plenum chamber 14. A plenum top means 26 extends across the upper area of plenum chamber 14 and extends over the plenum wall 22. This top means 26 includes an upwardly facing convex convection surface 28 which may be in the shape of an inverted cone. This convection surface becomes very well heated since heat rises and the heat which is gathered within the plenum chamber 14 will tend to continuously warm this convex convection surface 28.

A main housing means 32 is positioned fixedly with respect to the plenum housing 12. The main housing is preferably maintained at a spaced relation with respect to the plenum housing 12 by way of a plurality of support legs 39. The main housing means includes a cool air outlet 34 in the lower section thereof such that cool air traveling from the main housing can move downwardly through the cool air outlet. The main housing defines therein a cool air chamber 36 for providing a continuous supply of this cool air passing outwardly through the cool air outlet 34. This cool air shown as arrows 20 then will pass along the convex convection surface 28 and be warmed thereby. A main outlet means 38 is defined between the lower edge of the main housing means 32 and the upper edge of the plenum housing 12 in between the support legs 39. This main outlet means will allow the air which has now been warmed by the convection surface to travel outwardly therethrough into the surrounding environmental structure in a direction 360° around the heater. The movement of the warmed air is shown by arrow 18.

In order to maintain a continuous supply of cool air traveling outwardly through the cool air outlet 34, the main housing means 32 must define a cool air inlet means 40. As shown in FIG. 2, an upper cool air inlet means 62 may be included in the upper section of the main housing means 32 and a lower cool air inlet means 64 may be configured around the sidewall areas of the main housing means 32.

Air is drawn inwardly through the cool air inlet means 40 by the suction created by blower means 42. Preferably blower means 42 includes a fan means 44 operatively connected through a drive shaft means 45 to a drive means 46 for maintaining rotation thereof. The speed of this rotation may be varied by operation of a control means 48 such as a rheostat or the like. Switch means 52 is operable to provide or prevent electrical power to the drive means 46 and indicator means 50 will indicate the on or off mode of operation.

In order to maintain protection for the drive means 46 it is preferable to provide a separate drive compartment 54 within the main housing means 32. This drive compartment 54 may include along the lower area thereof a firewall means 56 to minimize the movement of excessive heat upwardly into the drive compartment 54 adjacent to the drive means 46. To allow the movement of cool air downwardly, a plurality of firewall apertures 56 may be positioned within the firewall in areas not adjacent to the drive means 46. Therefore, if excessive heat does build up within the unit, it will travel through the firewall apertures 58 and upward and out of the heat circulation device without causing damage to the drive means. For further heat protection a heat shield 60 may be maintained immediately below the drive means and it may be maintained in place by a heat shield support means 61 such that it is in spaced relation with respect to the firewall to provide added heat protection therewith.

To insure safety all inlets for cool air which will be somewhat adjacent to the fan means 44 may include a screen means 66 extending thereacross. Also the main power cord entering the drive compartment 54 may be maintained by a spring cord support 68 extending outwardly therefrom such that the power cord does not hang downwardly and contact either the portable heat circulation means of the present invention or the kerosene or other heater located therebelow. The spring cord support 68 maintains the cord in a horizontal direction for enough lateral distance outward to prevent such contact.

In operation the switch means 52 is turned to the on mode which activates indicator means 50 showing an operating condition. This indicator means 50 may take the form of a simple on and off light. The speed of drive of the drive means 46 may be controlled by the control means 48 and upon activation thereof drive shaft 45 will rotate causing rotation of fan means 44. Upon operation of the fan means 44, cool air will be drawn through the upper cool air inlet 62 and the lower cool air inlets 64 into the cool air chamber 36. This cool air will then travel downwardly through the cool air chamber 36 and exit therefrom through the cool air outlet 34. The general movement of this cool air is shown by cool air arrows 20. The air will then be caused to move outwardly in a radial direction along the cone-shaped convex convection surface and pick up heat therefrom. The movement of this warmed air is shown by arrows 18. This warmed air then travels outwardly and is circulated throughout the room. The movement of this air is facilitated by the lip means 30 which may be included extending about the outer edge of the convex convection surface 28. Further circulation of heated air is provided by the air exiting the main outlet means 38 in a location adjacent to the hot air apertures 24. The speed of movement of this air adjacent to these apertures will tend to create a suction as in the Venturi principle and draws warm air outwardly from the plenum chamber 14 for further warming of the surrounding environment.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A portable heat circulation means, particularly adapted to be placed upon heaters such as kerosene heaters, comprising:

(a) a plenum housing means defining a plenum chamber therein and adapted to be positionable upon a heater, said plenum housing means defining a plenum intake means therein to receive warm air to be gathered within said plenum chamber, said plenum housing further comprising:

1. a plenum wall means extending about said plenum chamber and defining a plurality of hot air apertures therethrough establishing fluid flow communication between said plenum chamber and the external environment; and
2. a plenum top means extending over said plenum wall means to define said plenum chamber therebelow, said plenum top means being generally convex in an upwardly facing direction to provide:
   a. a convex convection surface thereabove;
   b. a main housing means fixedly secured above said plenum housing means and defining a cool air inlet adjacent said convex convection surface, said main housing means defining a cool air chamber therein, said main housing means and said plenum housing means defining a main outlet means therebetween, said main housing means defining a cool air inlet means therein; and
   c. a blower means located within said main housing means and being operative to draw air inwardly through said cool air inlet means into said cool air chamber and outwardly through said cool air outlet means along said convex convection surface for heating thereof and out through said main outlet means into the surrounding environment.

2. The means as defined in claim 1 wherein said blower means comprises a fan means mounted within said main housing means and a drive means operatively secured to said fan means for rotation thereof.

3. The means as defined in claim 2 further including a control means in electrical connection with respect to said drive means to vary the speed of operation thereof to vary the speed of rotation of said fan means.

4. The means as defined in claim 2 further including an indicator means in electrical communication with respect to said drive means to be in the indicating mode responsive to operation of said drive means.

5. The means as defined in claim 2 further including a switch means in electrical communication with respect to said drive means to selectively interrupt and communicate electrical power to said drive means.

6. The means as defined in claim 2 wherein said main housing means defines a drive compartment within which said drive means is located and a firewall means separating said drive compartment from said cool air chamber to protect said drive means from excessive heat.

7. The means as defined in claim 6 wherein said firewall means defines firewall apertures therethrough to admit cool air into said cool air chamber.

8. The means as defined in claim 6 further including a heat shield fixedly secured to said firewall between said drive means and said firewall.

9. The means as defined in claim 1 wherein said convex convection surface is shaped as an inverted cone.

10. The means as defined in claim 1 wherein said main outlet means is located adjacent said hot air apertures to draw hot air therefrom when the air is flowing thereacross.

11. The means as defined in claim 10 wherein said convex convection surface includes a lip means extending outwardly therefrom over said plenum wall means to increase the suction of air traveling adjacent said hot air apertures and to increase the circulation of warmed air being circulated out through said main outlet means.

12. A portable heat circulation means, particularly adapted to be placed upon heaters such as kerosene heaters, comprising:

(a) a plenum housing means defining a plenum chamber therein and adapted to be positionable upon a heater, said plenum housing means defining a plenum intake means therein to receive warm air to be gathered within said plenum chamber, said plenum housing further comprising:

1. a plenum wall means extending about said plenum chamber and defining a plurality of hot air apertures therethrough establishing fluid flow communication between said plenum chamber and the external environment; and 2. a plenum top means extending over said plenum wall means to define said plenum chamber therebelow, said plenum top means being generally convex in an upwardly facing direction to provide:
   a. a convex convection surface thereabove being shaped like an inverted cone;
   b. a main housing means fixedly secured above said plenum housing means and defining a cool air inlet adjacent said convex convection surface, said main housing means defining a cool air chamber therein, said main housing means and said plenum housing means defining a main outlet means therebetween, located adjacent to said hot air apertures to suction hot air therefrom, said main housing means defining a cool air inlet means therein, said main housing means defining a drive compartment and defining a firewall means separating said drive compartment from said cold air chamber;
   c. a blower means located within said main housing means and being operative to draw air inwardly through said cool air inlet means into said cool air chamber and outwardly through said cool air outlet means along said convex convection surface for heating thereof and out through said main outlet means into the surrounding environment, said blower means further comprising a fan means mounted within said cool air chamber of said main housing means and a drive means mounted in said drive compartment thereof and operatively secured to said fan means for rotation thereof;
   d. a control means in electrical connection with respect to said drive means to vary the speed of operation thereof to vary the speed of rotation of said fan means;
   e. an indicator means in electrical communication with respect to said drive means to be in the indicating mode responsive to operation of said drive means; and
   f. a switch means in electrical communication with respect to said drive means to selectively interrupt and communicate electrical power to said drive means.

* * * * *